US006439925B1

(12) United States Patent
Lin et al.

(10) Patent No.: US 6,439,925 B1
(45) Date of Patent: Aug. 27, 2002

(54) RADIO FREQUENCY CABLE CONNECTOR ASSEMBLY

(75) Inventors: Hsien Chu Lin; Chieh Chao Yu; Chung Yen Yang, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/994,423

(22) Filed: Nov. 26, 2001

(30) Foreign Application Priority Data

Jul. 27, 2001 (TW) ..... 90212838 U

(51) Int. Cl.[7] ..... H01R 9/05
(52) U.S. Cl. ..... 439/578; 439/350
(58) Field of Search ..... 439/578, 579, 439/580, 581, 582, 583, 584, 585, 350

(56) References Cited

U.S. PATENT DOCUMENTS 3,671,922 A * 6/1972 Zerlin et al. ..... 439/578
4,326,769 A * 4/1982 Dersey et al. ..... 439/578
4,904,206 A * 2/1990 Laudig et al. ..... 439/578
5,074,809 A * 12/1991 Rousseau ..... 439/578

* cited by examiner

*Primary Examiner*—Hien Vu
(74) *Attorney, Agent, or Firm*—Wei Te Chung

(57) ABSTRACT

A radio frequency cable connector assembly comprises a first connector (1) and a second connector (2). The first connector includes a metallic first housing (10), a first insulator (11) fixed in the first housing, a conductive first contact (12) fixed in the first insulator and an elastic metallic sleeve (13) secured between the first housing and the first insulator. The sleeve forms a ridge (133) on a periphery thereof and the ridge is located at a distance from a free end of the sleeve. The first contact extends forwardly within the sleeve. The second connector includes a metallic second housing (20), a second insulator (21) fixed in the second housing, a second contact (22) fixed in the second insulator and located within the second housing, the second housing defining a groove (204) therein. The first and second connectors are coupled together in a manner that the first and second contacts engage with each other, the sleeve and the second housing electrically connect together, and the ridge of the sleeve of the first connector engages in the groove of the second housing.

1 Claim, 2 Drawing Sheets

RADIO FREQUENCY CABLE CONNECTOR ASSEMBLY

BACKGROUND OF THE INVENTION

1. Field of the invention

The present invention relates to a radio frequency (RF) cable connector assembly, and more particularly to an RF cable connector assembly which can provide a reliable engagement between two complementary connectors.

2. Related art

A conventional cable connector assembly is disclosed in U.S. Pat. No. 4,580,862. The cable connector assembly comprises a plug connector and a receptacle connector. The plug connector includes a first hollow housing and a plug contact encircled therein. The receptacle connector includes a second housing and a receptacle contact received therein. A thread is formed on an outer periphery of the second housing. In assembly, the second housing of the receptacle connector engages with the first housing of the plug connector, and, simultaneously the plug contact engages with the receptacle contact and the thread frictionally engages with an interior wall of the first housing to thereby establish a stable engagement of the plug and receptacle connectors. However, because the plug connector directly engages with the receptacle connector without any guiding mechanism, if there is an axial deviation between the plug and receptacle contacts when coupling, the misalignment will damage the one of both of the contacts. This situation will become worse in connector assembly of small form factor, since the small form factor connectors have relatively small size, resulting in that the contacts are relatively weak. Once the above-mentioned deviation is too large, the contacts are prone to break.

A solution used to overcome foresaid problems is taught in U.S. Pat. No. 5,611,707 ('707 patent). The '707 patent provides a microminiature coaxial connector assembly which locks a complementary connector by snap fastening. The assembly comprises a first connector and a second connector. The first connector has an elastic socket protruding from a cavity and a pin contact. The elastic socket forms an annular bead at a front end thereof. The second connector includes an insulative skirt, an annular groove defined in rear of the skirt and a socket contact. When coupling, the elastic socket firstly engages within the insulative skirt. This mechanism causes the contacts of the two connectors to align with each other before they are engaged with each other. Then the skirt is fittingly received in the cavity. Finally, the bead snaps in the groove to complete the assembly of the connectors. Regarding this prior art patent, however, if a force perpendicular to the coupling is applied to one connector of the assembly, said one connector is bent relative to the other connector. Such a bending force can disturb electrical connection between the contacts of the two connectors, or even damage the contacts. Moreover, the second connector forms an additional skirt accommodated in the second housing. It is difficult to manufacture the skirt precisely to meet the assembling tolerance when the size of the second connector is so small; thus, the cost of the second connector is high.

BRIEF SUMMARY OF THE INVENTION

It is an object of the present invention to provide an RF cable connector assembly for ensuring a reliable engagement between two complementary cable connectors.

According to the invention, an RF cable connector assembly comprises a first connector and a second connector. The first connector includes a metallic first housing, a first insulator fixed in the first housing, a conductive first contact fixed in the first insulator and an elastic metallic sleeve secured between the first housing and the first insulator. The sleeve forms a ridge on a periphery thereof and the ridge is located at a distance from a free end of the sleeve. The first contact extends forwardly within the sleeve. The second connector includes a metallic second housing, a second insulator fixed in the second housing, a second contact fixed in the second insulator and located within the second housing, the second housing defining a groove therein. The first and second connectors are coupled together in a manner that the first and second contacts engage with each other, the sleeve and the second housing electrically connect together, and the ridge of the sleeve of the first connector engages in the groove of the second housing.

A more complete appreciation of the present invention and the scope thereof can be obtained from the accompanying drawings which are briefly summarized below, the following detailed description of the presently-preferred embodiments of the present invention, and the appended claims.

DESCRIPTION OF THE PREFERRED EMBODIMENT

Figure 1:
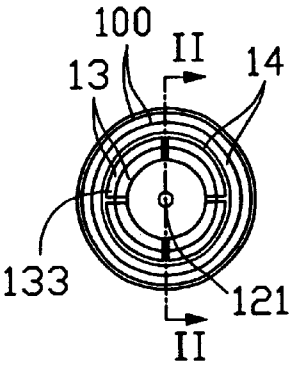
FIG. 1 is a front elevational view of a first connector of an RF cable connector assembly of the present invention.
Figure 2:
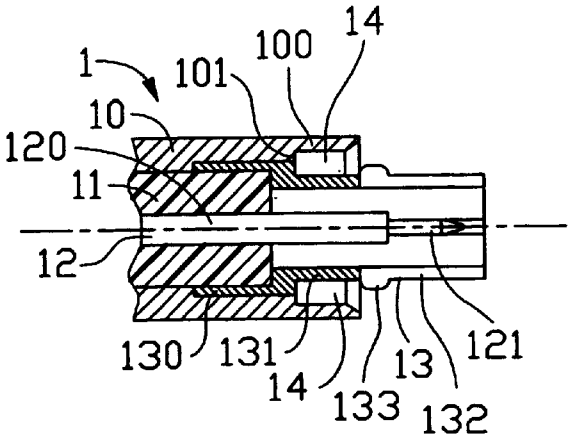
FIG. 2 is a cross-sectional view of the first connector of the assembly of the present invention, taken along line II—II of FIG. 1.
Figure 3:
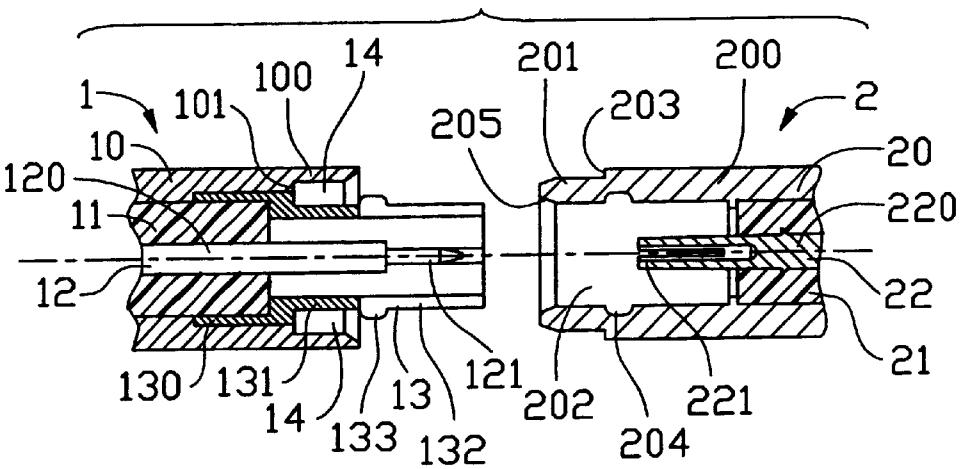
FIG. 3 is a cross-sectional view of the assembly of the present invention, before coupling.
Figure 5:
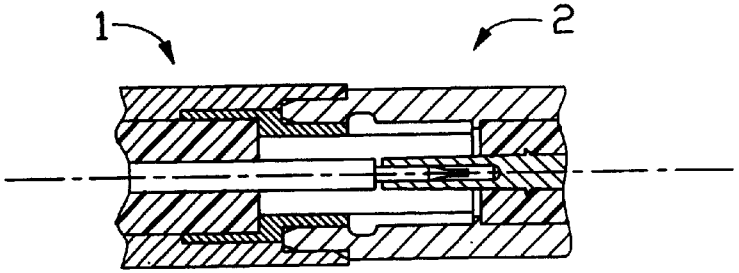
FIG. 5 is a cross-sectional view of the assembly of the present invention in a coupled state.

Referring to FIGS. 1–3, an RF cable connector assembly comprises a first connector 1 and a second connector 2 for coupling together. The first connector 1 comprises a metallic first housing 10, a first insulator 11, and a conductive first contact 12 received within the first insulator 11. The insulator 11 and the first contact 12 are both accommodated in the first housing 10. The first housing 10 has a front portion 100. A first receiving space 14 is defined in the front portion 100. An internal annular step 101 is formed in the first housing 10 immediately behind the receiving space 14. The first contact 12 includes a first positioning portion 120 secured in the first insulator 11, and a first coupling portion 121 extending forwardly from the first positioning portion 120. In the preferred embodiment, the first coupling portion 121 is a round pin. An elastic metallic sleeve 13 is positioned between the front portion 100 of the first housing 10 and the first insulator 11. The sleeve 13 includes a retaining portion 130 fixedly sandwiched between the first housing 10 and the first insulator 11, and an elastic portion 131 extending forwardly from the retaining portion 130. The elastic portion 131 has a rear portion (not labeled) disposed within the first receiving space 14, and a front portion extending forwardly beyond the front portion 100. The elastic portion 131 comprises four spring leaves 132 arranged in a circle to surround the first coupling portion 121. A ridge 133 is formed on an outer periphery of the spring leaves 132 immediately in front of the front portion. In other words, the ridge 133 is located at a distance from a free end of the sleeve 13. A cable (not shown) has a central signal conductor electrically connected with the first contact 12, and a grounding braid around the central signal conductor. The grounding braid is electrically connected with the first housing 10. Since the cable and its connection with the first connector 1 are well known by those skilled in the art, a detailed description thereof is omitted here, and it is not known in the drawings.

The second connector 2 comprises a hollow, metallic second housing 20, a second insulator 21 retained in the second housing 20, and a conductive second contact 22 retained in the second insulator 21. The second housing 20 includes a main body 200 having a front cylindrical protrusion 201. A step 203 is formed between the protrusion 201 and the main body 200. An annular groove 204 is defined in an inner wall of the main body 200 immediately rearwards of the protrusion 201. A second receiving space 202 is integrally defined through the protrusion 201 and in the main body 200. A front end of the protrusion 201 has an annular inner chamfer 205 so that the second receiving space 202 has a flared inlet. The second contact 22 includes a second positioning portion 220 retained in the second insulator 21 and a second coupling portion 221 protruding forwardly beyond a front face of the second insulator 21 into the second receiving space 202. In the preferred embodiment, the second coupling portion 221 is forked.

Figure 4:
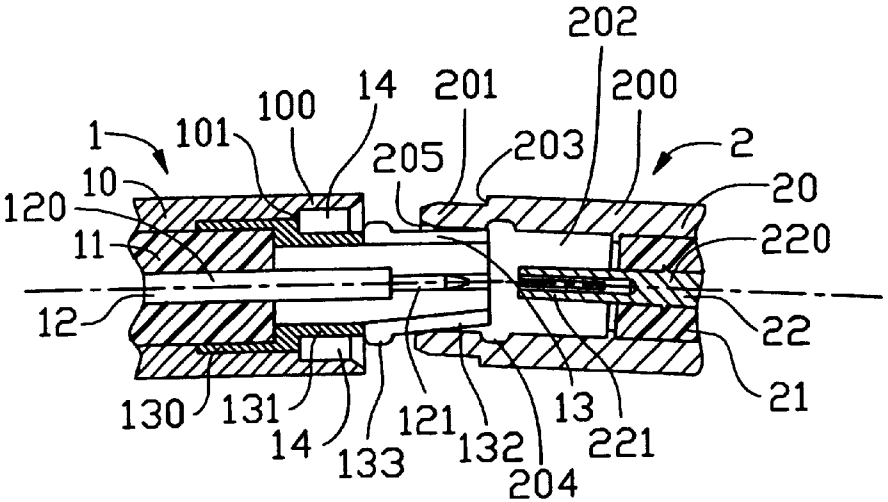
FIG. 4 is a cross-sectional view of the assembly of the present invention in a process of coupling.

Referring to FIGS. 3–4, in mating, the spring leaves 132 of the sleeve 13 of the first connector 1 are firstly inserted into the second receiving space 202 of the second connector 2. The protrusion 201 of the second connector 2 guides the insertion of the spring leaves 132 whereby a deviation of alignment between the first and second contacts 11, 22 can be prevented to minimum extent to avoid a damage of the contacts 11, 22 during the mating process (FIG. 3). Thereafter, the sleeve 13 is filly inserted into the second receiving space 202 to complete the coupling of the two connectors 1, 2, in which the first coupling portion 121 of the first contact 12 is inserted into the second coupling portion 221 of the second contact 22 so that the first and second contacts 11, 22 are electrically connected together. Furthermore, the ridge 133 of the sleeve 13 snaps into the groove 204 of the main body 200 of the second housing 20, whereby the first housing 10 and the second housing 20 are electrically connected together. The protrusion 201 is received in the first receiving space 14, and an annular front edge of the protrusion 201 abuts against the step 101 while a front edge of the front portion 100 of the first housing 10 abuts against the step 203. The flared configuration of the inlet of the second receiving space 202 facilitates the insertion of the sleeve 13 into the second receiving space 202.

In comparison with prior arts, the ridge 133 of the present invention is located at a distance from the free end of the sleeve 13. By such design, a force perpendicular to the insertion direction is applied to the first connector 1 after coupling, a moment generated by such force to a fulcrum which is the engaging point between the ridge 133 and the groove 204 will be offset by a counteracting moment generated by a counteracting force to the same fulcrum. The counteracting force is derived from the second housing 20 acting on the free end of the metallic sleeve 13. Thus, a possible damage or break of the contacts due to such bending force can be avoided.

The scope of the present disclosure includes any novel feature or combination of features disclosed therein either explicitly or implicitly or any generalization thereof irrespective of whether or not it relates to the claimed invention or mitigates any or all of the problems addressed by the present invention. The applicant hereby gives notice that new claims may be formulated to such features during prosecution of this application or of any such further application derived therefrom.

We claim:

1. A cable connector assembly comprising:

a first connector comprising a metallic first housing, a first insulator fixed in the first housing, a sleeve having a rear retaining portion fixed between the first housing and the first insulator and a front spring portion extending forwardly beyond a front end of the first housing, a ridge formed on an outer periphery of the sleeve and located immediately in front of the front end of the first housing, and a conductive first contact having a rear positioning portion secured to the first insulator and a front coupling portion located within the spring portion of the sleeve; and a second connector comprising a metallic second housing, a second insulator fixed in the second housing and a conductive second contact having a rear positioning portion secured to the second insulator and a front coupling portion located in a receiving space defined in a front portion of the second housing, the second housing defining a groove in the receiving space; wherein the spring portion of the sleeve of the first connector enters the receiving space of the second connector, the ridge of the sleeve of the first connector fits into the groove of the second housing so that the first and second housing are electrically connected together and the coupling portion of the first contact engages with the coupling portion of the second contact; wherein the second housing comprises a protrusion in front of the groove and the first housing having a recessed front portion thereby defining a space therein, the protrusion fitting into the space defined by the recessed front portion; wherein the recessed front portion and the receiving space of the second housing have a flared inlet; wherein the coupling portion of the first contact has a configuration of a round pin and the coupling portion of the second contact has a configuration like a fork; wherein the second housing defines a step in rear of the protrusion, the front end of the first housing engaging with the step.

* * * * *